US005325983A

United States Patent [19]

Imai et al.

[11] Patent Number: 5,325,983

[45] Date of Patent: Jul. 5, 1994

[54] LIQUID CONTAINER WITH SPOUT

[75] Inventors: Takayuki Imai; Yoshiaki Take; Hideki Yamamoto; Ken Shimatani, all of Tokyo, Japan

[73] Assignee: Fujitsu Limited, Kanagawa, Japan

[21] Appl. No.: 953,840

[22] Filed: Sep. 30, 1992

[30] Foreign Application Priority Data

Sep. 30, 1991 [JP] Japan ..... 3-86727

[51] Int. Cl.[5] ..... B65D 17/42

[52] U.S. Cl. ..... 220/277; 220/359; 220/462; 222/83; 222/541; 229/125.15

[58] Field of Search ..... 220/277, 278, 359, 462; 215/232; 222/83, 541, 566; 229/125.15; 383/66, 80, 96, 906

[56] References Cited

U.S. PATENT DOCUMENTS

| | | | |
|---|---|---|---|
| 4,483,464 | 11/1984 | Nomura | 222/83 |
| 4,813,578 | 3/1989 | Gordon et al. | 222/541 |
| 4,948,015 | 8/1990 | Kawajiri et al. | 222/107 |
| 5,141,133 | 8/1992 | Ninomiya et al. | 222/83 |

*Primary Examiner*—Allan N. Shoap
*Assistant Examiner*—Nova Stucker
*Attorney, Agent, or Firm*—Staas & Halsey

[57] ABSTRACT

A liquid container with a spout is disclosed. A composite sheet for the container body comprises an innermost layer of a low-smelly and low-adsorbent resin and an outermost layer of a polyolefine resin. A sealing film comprising a liquid-contacting layer and a sealing layer both made of the low-smelly and low-adsorbent resin seals a spouting hole in the container body from inside the container body. The container body and the spout sandwich a connecting film and a spout-attached film. The connecting film has a hole in alignment with and adjoining the hole in the container body. The connecting film comprises an innermost layer of a polyolefine resin and an outermost layer of the same resin as the innermost resin of the container body. The connecting film is heatsealed to the outermost layer of the container body. The spout-attached film has a hole in alignment with and adjoining the hole in the container body. The hole in the spout-attached film has a smaller diameter than the hole in the container body. The spout-attached film comprises an outermost layer of a polyolefine resin and an innermost layer of the same resin as the innermost layer of the container body. The spout-attached film is heatsealed to an area between the connecting film and the sealing film so that the edge of the rear hole in the spout-attached film is positioned on a portion of the outermost layer of the sealing film adjoining the hole in the container body.

6 Claims, 2 Drawing Sheets

LIQUID CONTAINER WITH SPOUT

BACKGROUND OF THE INVENTION

1. Field of the Invention

The present invention relates to an improvement in a liquid container made of a composite sheet and having a spout attached to the exterior surface of the container body.

2. Background Art

As well known, liquid containers made of a composite sheet comprising a paper layer as the core and resin films laminated on the front and back surfaces of the paper layer are widely used as containers filled with juice, milk, mineral water, alcoholic drink and the like. Spouts of the liquid containers are classified into an exterior type of which a spout is attached to an exterior surface of a liquid container and an interior type of which a spout is inserted from inside a liquid container into a hole in the composite sheet and attached to an interior surface of the liquid container. The exterior type is superior in productivity and on the other hand the interior type is superior in appearance.

There is well known as the exterior type liquid container with a spout a liquid container of Japanese examined utility model application publication SHO.58-37828. In the structure of this liquid container, a sealing film b, as shown in FIG. 2, seals from inside the container body a a circular hole H serving as a spout-attached portion of the container body a. This liquid container involves a problem that since an opening of the sealing film b by means of an opening blade d of a plug c, causes the edge surface of the paper core of the composite sheet defining the hole H in the container body a to contact a liquid content in the liquid container to be swollen the liquid container is degraded in strength and/or deformed.

FIG. 3 shows a liquid container with a spout of Japanese examined utility model application publication SHO.63-18582 for overcoming this problem. In the structure of this liquid container, an annular spout-attached film e having a smaller diameter than the hole H in the container body a is sandwiched between the container body a and the spout c to ensure the attachment of the spout c to the container body a. The spout-attached film e also is bonded to the outer surface of the sealing film b to prevent the edge surface of the paper core of the composite sheet defining the hole H in the container body a from a contact with a liquid content in the liquid container.

These liquid containers are made of a composite sheet the opposite surfaces of which are covered with a polyolefine resin of high heatsealability, for example, polyethylene resin (referred to as PE resin hereinafter). Since PE resin tends to adsorb an aromatic component of an orange juice or the like and oxidation and decomposition of PE resin create a peculiar smell, the odor and the flavor of liquid content tend to be unbalanced.

There are known as resins adsorbing a small quantity of an aromatic component and creating a small quantity of smell polyester resin and ethylene-vinyl alcohol copolymer resin. Since these low-smelly and low-adsorbent resins have a poor heatsealability to polyolefine resin, it is difficult that the prior art sealing film b seals the hole H in the container body a from inside the container body a when the innermost layer of the container body a constituting a liquid-contacting layer is made of one of the low-smelly and low-adsorbent resins.

To overcome this problem, the present applicants proposed a liquid container with a spout in Japanese utility model application HEI.3-6431. FIG. 4 shows this liquid container with the spout. In the structure of this liquid container, the container body a is made of a composite sheet, the composite sheet comprising the core f, an outermost layer g of PE resin on the core f and an innermost layer h of polyester resin (i.e. a low-smelly and low-adsorbent resin) on the core f. A sealing film b is bonded to a portion of the innermost layer h of the container body a surrounding the hole H so that the composite sheet of the container body a and the sealing film b sandwich a connecting film i having a hole with a diameter equal to or slightly larger than that of the hole H. An annular spout-attached film e having a circular hole with a diameter than the hole H is bonded to a part of the outermost layer g surrounding the hole H, to the edge surfaces of the hole H and the hole in the connecting film i, and to a part of the outermost layer of the sealing film b. A spout c is attached to the spout-attached film e.

The connecting film i comprises the core, an outermost layer 1 of polyester resin adjoining the inner-most layer h of the container body a and an innermost layer k of PE resin adjoining the sealing film b. The outermost layer j of the connecting film is heatsealed to the innermost layer h of the container body a with both the outermost layer 1 and the innermost layer h made of polyester resin.

The sealing film b comprises the core, an outermost layer 1 of PE resin adjoining the connecting film i and an innermost layer m of polyester resin. The outermost layer 1 of the sealing film b is heatsealed to the innermost layer k of the connecting film i.

The spout-attached film e comprises the core, an outermost layer n of PE resin (the same resin as the spout c) adjoining the spout c and an innermost layer o of PE resin adjoining the container body a. The spout-attached film e, as described above, extends from the part of the container body a surrounding the hole H to the sealing film b and is heatsealed to the spout c, the container body a, the connecting film i and the sealing film b.

In the structure in which the spout-attached film is attached to the exterior surface of the container body and the connecting film and the sealing film are arranged on the interior surface side of the container body, there may be problems in that since portions of the sealing film and the connecting film frequently contacting a liquid content must be made of a polyolefine resin (e.g. PE resin) these portions tend to adsorb an aromatic component and the smell of the polyolefine resin tends to transfer to the liquid content.

In addition, since the natures of the innermost and outermost layers of the sealing film are different, the sealing film tends to wrinkle during heatsealing of the sealing film and the connecting film. The spout-attached film thus is insufficiently heatsealed to the sealing film which has wrinkled. The heatsealed Joint between the two films tends to cause a pinhole. Therefore, there may be a problem that the liquid content possibly infiltrates the container body after the liquid content is spouted through an opened sealing film and therefore the hole in the container body.

SUMMARY OF THE INVENTION

In view of the situation described above, the present inventors provided a liquid container in Japanese utility model application HEI.3-25666. This liquid container has a structure in which a sealing film comprising a low-adsorbent layer of polyester resin adjoining a hole in the container body seals from inside the container body the hole in the container body comprising an innermost layer of a low-adsorbent resin, a connecting film (on a container body side) and a spout-attached film (on a spout side) are sandwiched between the container body and the spout, a low-adsorbent layer of polyester resin on a spout-attached film side of the connecting film is bonded to a low-adsorbent layer of polyester resin on a connecting film side of the spout-attached film, and a low-adsorbent layer of polyester resin of the spout-attached film is bonded to the low-adsorbent layer of polyester resin of the sealing film.

A primary object of the present invention is to provide a liquid container having a good sealing performance in which an innermost layer of the container body, a container body side resin of a sealing film adjoining the innermost layer of the container body, a spout-attached film side resin of a connecting film, and a resin of the spout-attached film adjoining both the connecting film and the sealing film are suitably selected.

Another object of the present invention is to provide a liquid container comprising the innermost layer of the container body of polyester resin or ethylene-vinyl alcohol copolymer resin, the liquid container enabling a spout-attached hole in the container body to be easily sealed, the liquid container adsorbing a small quantity of an aromatic component, a small quantity of smell of the polyolefine resin transferring to a liquid content (i.e. the polyolefine resin is not in direct contact with the liquid content), no liquid content infiltrating the container body after the spout is opened.

To overcome a prior art problem, an inventive liquid container having a spout attached to the exterior surface of a part defining a spouting hole in the container body of a composite sheet has a structure in which the composite sheet has a layered composition of an innermost layer of a low-smelly and low-adsorbent resin/the core of paper/an outermost layer of a polyolefine resin, a sealing film seals the hole in the composite sheet from inside the container body, the sealing film having a layered composition of a liquid-contacting layer/the core/a sealing layer, both the liquid-contacting layer and the sealing layer being made of a low-smelly and low-adsorbent resin, a connecting film and a spout-attached film are sandwiched between the container body and the spout of a polyolefine resin sequentially from a container body, the connecting film has a hole coaxially adjoining the hole in the container body and having a diameter equal to or slightly larger than the hole in the container body, the connecting film having a layered composition of a container body side innermost layer of a polyolefine resin and a spout-attached film side outermost layer of the same layer as the innermost layer of the container body, the innermost layer of the connecting film is heatsealed to the outermost layer of the container body, the spout-attached film has a hole having a smaller diameter than the hole in the container body, the hole in the spout-attached film coaxially adjoining the hole in the container body, the spout-attached film having a layered composition of a spout side outermost layer of a polyolefine resin/the core/a connecting film side innermost layer of the same resin as the innermost layer of the container body, the spout-attached film is heatsealed to an area between the outermost layer of the connecting film and a portion of the outermost layer of the spout-attached film adjoining the hole in the container body so that a part of the spout-attached film surrounding the hole in the spout-attached film adjoins said portion of the outermost layer of the spout-attached film, and the spout is heatsealed to the outermost layer of the spout-attached film.

In the present invention, the liquid-contacting layer and the sealing layer of the sealing film are made of the same resin so as not to be wrinkled during heatsealing of these two layers and the heatsealability between the container body and the sealing film is good so that the spout-attached film can be well heatsealed to the sealing film.

According to the liquid container with the spout of the present invention, all of the interior surfaces of the liquid container in contact with the liquid content are made of the low-smelly and low-adsorbent resin such as polyester resin, ethylene-vinyl alcohol copolymer resin or nylon resin, so that odors cannot be unbalanced if the liquid container is filled with a juice, mineral water, Japanese sake, or whiskey. In addition, heatsealing the layers of the same resins to each other enhances the quality of heatsealing to ensure a sufficient sealing strength. Since the spout-attached film on the front of the hole in the container body and the sealing film on the rear of the hole in the container body are heatsealed to each other to cover the edge surface of the composite sheet of the container body, the opening of the sealing film by means of an opening blade mounted within the spout cannot cause the liquid content in the container to infiltrate the paper core of the composite sheet of the container body.

DETAILED DESCRIPTION OF THE PREFERRED EMBODIMENTS

A preferred embodiment of the present invention will be described with reference to FIG. 1.

Figure 1:
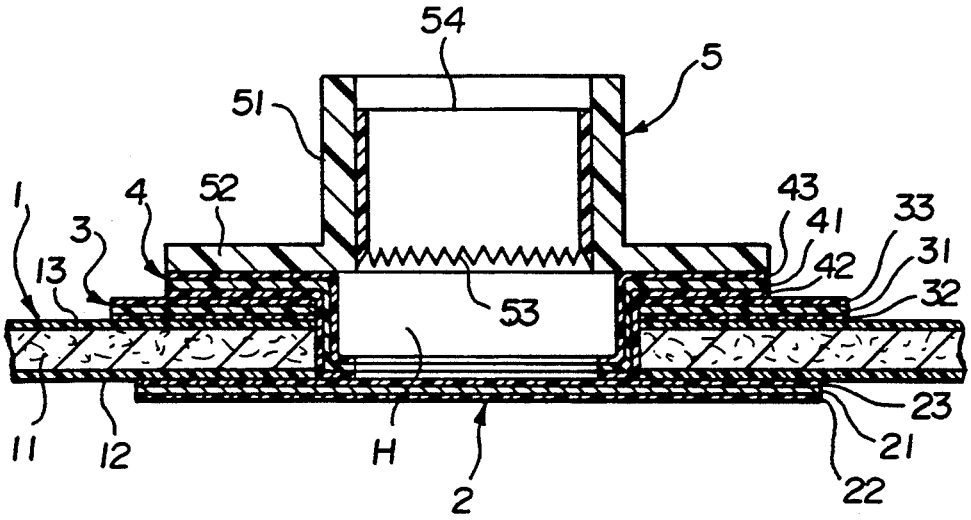
FIG. 1 is a sectional view of a liquid container with a spout according to an embodiment of the present invention, showing the spout and a part of the liquid container in the vicinity thereof.
Figure 2:
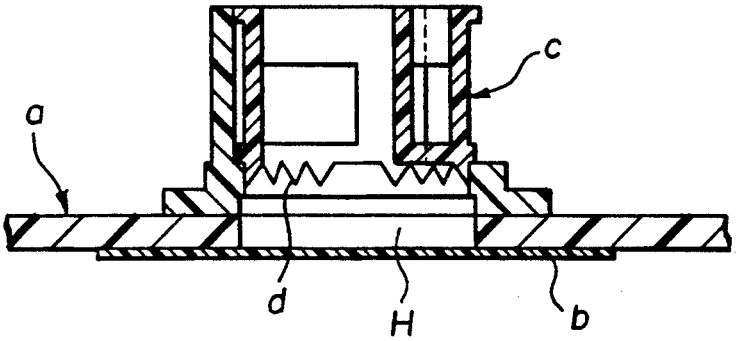
FIG. 2 is a sectional view of a first prior art liquid container with a spout, showing the spout and a part of the liquid container in the vicinity thereof.
Figure 3:
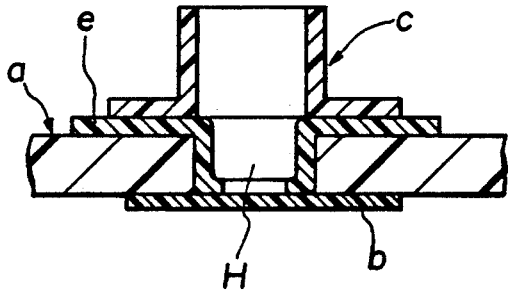
FIG. 3 is a sectional view of a second prior art liquid container with a spout similar to FIG. 2.
Figure 4:
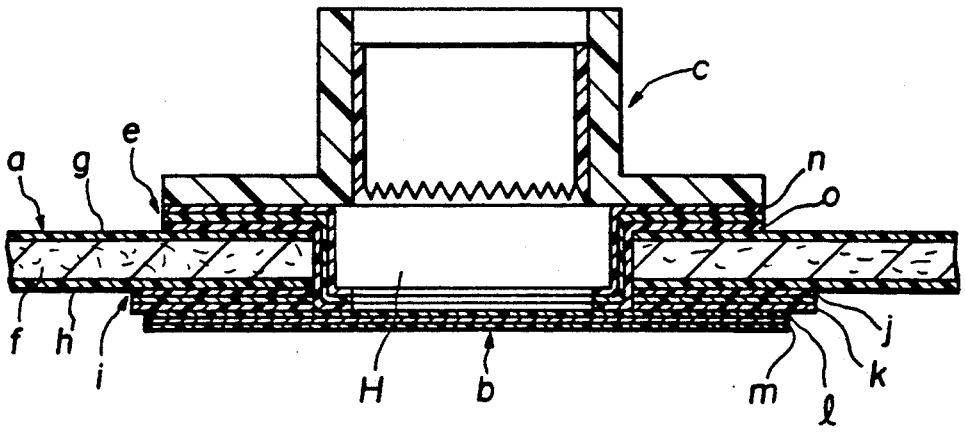
FIG. 4 is a sectional view of a third prior art liquid container with a spout similar to FIG. 2.

In FIG. 1, a container body is indicated at 1, a sealing film is indicated at 2, a connecting film is indicated at 3, a spout-attached film is indicated at 4, and a spout is indicated at 5. The container body 1 is made of a composite sheet having a layered composition of an innermost layer 12 of a low-smelly and low-adsorbent resin/-the core 11/an outermost layer 13 of PE resin. A predetermined portion of the container body 1 has a spouting hole H. A composite sheet for the container body 1 preferably comprises an innermost layer (i.e. liquid-contacting layer) of a heatsealable resin and an outermost layer of flexible high-workable PE resin. Thus, the low-smelly and low-adsorbent resin of the innermost layer 12 is selected because of its heatsealability, low-adsorptiveness causing the low-smelly and low-adsorbent resin to resist an adsorption of an aromatic component, and low resin-smelling property. A well-known polyolefine resin superior in heatsealability is selected as the PE resin of the outermost layer 13. The core 11 comprises paper making the entire composite sheet rigid, aluminum foil providing a high barrier against gas and light, and drawn polyethylene terephthalate resin (referred to as drawn PET resin hereinafter ).

The sealing film 2 is a composite film sealing the hole H in the container body 1 from inside the container body 1. The sealing film 2 comprises a core 21, a liquid-contacting layer 22 laminated on the innermost surface of the core 21, and a sealing layer 23 laminated on the outermost surface of the core 21. The core 21 is made of aluminum foil for increasing a barrier performance against Gas and light. The liquid-contacting layer 22 is made of drawn polyester resin. The sealing layer 23 is made of the low-smelly and low-adsorbent resin which resists the adsorption of an aromatic component, has the so-called low-adsorptiveness and the weak resin smell and is heatsealable to the innermost layer 12 of the container body 1. The sealing layer 23 is heatsealed to the innermost layer 12 of the container body 1. The drawn polyester resin of the liquid-contacting layer 22 may be replaced with nylon resin.

The connecting film 3 is attached to the outer-most layer 13 of the container body 1 so that the hole in the connecting film 3 is aligned with the hole H in the container body 1. The connecting film 3 is a composite film of a core 31 of drawn polyester resin, a container body 1 side innermost layer 32 of PE resin and a spout-attached film 4 side outermost layer 33 of the same resin (i.e. low-smelly and low-adsorbent resin) as the innermost layer 12 of the container body 1. This resin is heatsealable to an innermost layer 42 of the spout-attached film 4. The connecting film 3 has a Good heatsealability to both the container body 1 and the spout-attached film 4.

The connecting film 3 has an annular shape having a hole having a diameter equal to or slightly larger than the hole H in the container body 1. The connecting film 3 is positioned on and heatsealed to the outermost layer 13 of the container body 1 so that the hole in the connecting film 3 aligns with the hole H in the container body 1. The connecting film 3 has an outer diameter equal to or slightly larger than the outer diameter of the spout-attached film 4 so that the spout-attached film 4 is not heatsealed directly to the outermost layer 13 of the container body 1. The drawn polyester resin of the film core 31 may be replaced with nylon resin.

The spout-attached film 4 is a composite film of the core 41 of drawn PET resin, an innermost layer 42 of the same resin as the innermost layer 12 of the container body 1, this resin being heatsealable to both the outermost layer 33 of the connecting film 3 and the sealing layer 23 of the sealing film 2, and an outermost layer 43 of PE resin.

The spout-attached film 4 is annular and has an outer diameter after heatsealing substantially equal to the diameter of a flange 52 of the spout 5. The diameter of the hole in the spout-attached film 4 is smaller than that of the hole H in the container body 1. The spout-attached film 4 is heatsealed to both the outermost layer 33 of the connecting film 3 and a portion of the sealing layer 23 of the sealing film 2 adjoining the hole H in the container body 1. That is, the spout-attached film 4 extends from the outermost layer 33 of the connecting film 3 to the outermost layer 23 of the sealing film 2 so that the edge of the smaller hole in the spout-attached film 4 is positioned on a portion of the outermost layer 23 of the sealing film 2 adjoining the hole H in the container body 1.

The inner diameter of the portion of the spout-attached film 4 heatsealed to the sealing film 2 (i.e. the diameter of the smaller hole in the spout-attached film 4) is larger than the outer diameter of a cylindrical internal plug 54 received in the spout 5. Therefore, even if a portion of the sealing film 2 associated with a central part of the hole H in the container body 1 is opened by means of an opening blade 53 of the internal plug 54, the heatsealed portion of the spout-attached film 4 protects the edge of the composite sheet of the container body 1 defining the hole H from being broken so that the liquid content cannot infiltrate the paper of the core 11 of the composite sheet. The drawn polyester resin of the core 41 of the spout-attached film 4 may be replaced with nylon resin.

The spout 5 is made of a polyolefine resin of a good heatsealability such as PE resin. The spout 5 comprises a spouting cylinder 51 having an inner diameter substantially equal to the diameter of the hole H in the container body 1, and a flange 52 at the rear end of the spouting cylinder 51. The rear surface of the flange 52 is heatsealed to the outermost layer 43 of the spout-attached film 4 to fasten the spout 5 to the exterior surface of the container body 1.

The opening blade 53 for opening the sealing film 2 is provided on the rear end of the cylindrical internal plug 54 and has a serration. In FIG. 1, since the internal plug 54 is fitted axially movably within the spout 5, the internal plug 54, for example, is depressed to cause the opening blade 53 to penetrate and open the sealing film 2. Alternatively, the spout 5 may have an opening structure in which rotating a cap (not shown) in a direction of detachment depresses the internal plug 54 so that the opening blade 53 penetrates and opens the sealing film 2.

Low-smelly and low-adsorbent resins for the innermost layer 12 of the container body 1 may comprise resins capable of adsorbing a small quantity of an aromatic component and having a weak resin smell, such as polyester resin, ethylene-vinyl alcohol copolymer resin, nylon resin and polyacrylonitrile resin. In particular, the followings preferably are employed:

- copolymerized polyester resin (SELAR PT X207 and SELAR PT J802 produced by Mitsui Dupont Polychemical Co., Ltd. and PET G 6763 and PET G 5116 pl produced by Eastman Kodak Co., Ltd. )
- ethylene-vinyl alcohol copolymer resin (EVAL G produced by KURARAY CO., LTD. and SOANOL produced by The Nippon Synthetic Chemical Industry Co., Ltd. )
- amorphous nylon resin (SELAR PA 3426 produced by Mitsui Dupont Polychemical Co., Ltd. ).

Resins for each film were selected as follows and these films were tested.

EXAMPLE 1

Employing SELAR PT J802 as the low-smelly and low-adsorbent resin of the container body and the heatsealable resins of the sealing film 2, the connecting film 3 and the spout-attached film 4, a liquid container was made. The liquid container was filled with 40%-ethanol solution and then hermetically sealed. Then, internal plug 54 is depressed within the spout 5 to open the sealing film 2. After the opened spout 5 was capped, the liquid container was fallen sideways on a spout-attached side of the container body 1 and left as it is. After 1 hr, the spout 5 and its surrounding part were visually inspected.

EXAMPLE 2

Substantially the same liquid container as that in Example 1 was made except that the low-smelly and low-adsorbent resin of the container body 1 and heatsealable resins of the sealing film 2, the connecting film 3 and the spout-attached film 4 were PET G 6763. The liquid container was evaluated in the same manner as in Example 1.

EXAMPLE 3

Substantially the same liquid container as that in Example 1 was made except that the low-smelly and low-adsorbent resin of the container body 1 and heatsealable resins of the sealing film 2, the connecting film 3 and the spout-attached film 4 were SOANOL A. The liquid container was evaluated in the same manner as in Example 1.

Substantially the same liquid container as that in Example 1 was made except that the low-smelly and low-adsorbent resin of the container body 1 and heatsealable resins of the sealing film 2, the connecting film 3 and the spout-attached film 4 were SELAR PA 3426. The liquid container was evaluated in the same manner as in Example 1.

EXAMPLE 5

Substantially the same liquid container as that in Example 1 was made except that the low-smelly and low-adsorbent resin of the container body 1 and the heatsealable resin of the sealing film 2 were SELAR PT J802. The heatsealable resins of the connecting film 3 and the spout-attached film 4 were PET G 6763. The liquid container was evaluated in the same manner as in Example 1.

CONTROL 1

Employing SELAR PT J802 as low-adsorbent heatsealable resins of the container body 1 and the sealing film 2 of a liquid container with a spout disclosed in Japanese utility model application HEI.3-6431, a liquid container was made. The liquid container was filled with 40%-ethanol solution and then hermetically sealed. Then, internal plug 54 is depressed within the spout 5 to open the sealing film 2. After the opened spout 5 was capped, the liquid container was fallen sideways on a spout-attached side of the container body 1 and left as it is. After 1 hr, the spout 5 and its surrounding part were visually inspected.

CONTROL 2

Substantially the same liquid container as that in Control 1 was made except that the heatsealable, low-smelly, low-adsorbent resins of the container body and the sealing film of the liquid container with the spout disclosed in Japanese utility model application HEI.3-6431 were PET G 6763. The liquid container was evaluated in the same manner as in Control 1.

CONTROL 3

Substantially the same liquid container as that in Control 1 was made except that the heatsealable, low-smelly, low-adsorbent resins of the container body and the sealing film of the liquid container with the spout disclosed in Japanese utility model application HEI.3-6431 were SOANOL A. The liquid container was evaluated in the same manner as in Control 1.

CONTROL 4

Substantially the same liquid container as that in Control 1 was made except that the heatsealable, low-smelly, low-adsorbent resins of the container body and the sealing film of a liquid container with a spout disclosed in Japanese utility model application HEI.3-6431 were SELAR PA. The liquid container was evaluated in the same manner as in Control 1.

Table 1 shows results of evaluation of the examples of the present invention and the controls.

TABLE 1

| | Results of Evaluation | |
|---|---|---|
| | Nature Observation | Number of Defective containers |
| Example 1 | Good and no solution infiltrated. | 0/20 |
| Example 2 | " | 0/20 |
| Example 3 | " | 0/20 |
| Example 4 | " | 0/20 |
| Example 5 | " | 0/20 |
| Control 1 | There were some liquid containers in which some solution infiltrated part surrounding the spout. | 7/20 |
| Control 2 | There were some liquid containers in which some solution infiltrated part surrounding the spout. | 7/20 |
| Control 3 | There were some liquid containers in which some solution infiltrated part surrounding the spout. | 10/20 |
| Control 4 | There were some liquid containers in which some solution infiltrated part surrounding the spout. | 8/20 |

What is claimed is:

1. A liquid container with a spout attached to an exterior surface of a part defining a spouting hole in the container body of a composite sheet, wherein:

the composite sheet has a layered composition of an innermost layer of a low-smelly and low-absorbent resin/a core of paper/an outermost layer of a polyolefin resin;

a sealing film sealing the hole in the composite sheet from inside the container body, the sealing film having a layered composition of a liquid-contacting layer/a core/a sealing layer, both the liquid-contacting layer and the sealing layer being made of a low-smelly and low-adsorbent resin;

a connecting film and a spout-attached film sandwiched between the container body and the spout of a polyolefin resin sequentially from said container body;

the connecting film having a hole coaxially adjoining the hole in the container body and having a diameter compatible with the hole in the container body, the connecting film having a layered composition of a container body side innermost layer of a polyolefin resin/a core/a spout-attached film side outermost layer of the same resin as the innermost layer of the container body, the innermost layer of the connecting film being heatsealed to the outermost layer of the container body;

the spout-attached film having a hole of smaller diameter than the hole in the container body, the hole in the spout attached film coaxially adjoining the hole in the container body;

the spout-attached film having a layered composition of a spout side outermost layer of a polyolefin resin/a core/a connecting film side innermost layer of the same resin as the innermost layer of the container body;

the spout-attached film being heatsealed to an area between the outermost layer of the connecting film and a portion of the outermost layer of the sealing film adjoining the hole in the container body so that a part of the spout-attached film surrounding the hole in the spout-attached film adjoins said portion of the outermost layer of the sealing film; and the spout being heatsealed to the outermost layer of the spout-attached film.

2. The liquid container with the spout according to claim 1, wherein the low-smelly and low-adsorbent resin is polyester resin.

3. The liquid container with the spout according to claim 1, wherein the low-smelly and low-adsorbent resin is ethylene-vinyl alcohol copolymer resin.

4. The liquid container with the spout according to claim 1, wherein the low-smelly and low-adsorbent resin is nylon resin.

5. The liquid container with the spout according to claim 1, wherein the low-smelly and low-adsorbent resin is polyacrylonitrile resin.

6. A liquid container with a spout attached to an exterior surface of a part thereof defining a first spouting hole in the container body of a composite sheet, comprising:

the composite sheet having a layered composition of an innermost layer of a low-smelly and low-adsorbent resin/a core of paper/an outermost layer of a polyolefin resin;

a sealing film sealing the hole in the composite sheet from inside and container body, said sealing film having a layered composition of a liquid-contacting layer/a core/a sealing layer, both the liquid-contacting layer and the sealing layer being made of a low-smelly and low-adsorbent resin;

a connecting film having a second hole coaxially adjoining the hole in said container body and having a diameter compatible with the first hole in said container body, said connecting film having a layered composition of a container body side innermost layer of a polyolefin resin/a core/a spout-attached film side outermost layer of the same resin as the innermost layer of said container body, the innermost layer of said connecting film being heatsealed to the outermost layer of said container body;

a spout-attached film having a third hole, the third hole having a smaller diameter than the first hole in said container body, the third hole in said spout-attached film coaxially adjoining the first hole in said container body, said spout-attached film having a layered composition of a spout side outermost layer of a polyolefin resin/a core/a connecting film side innermost layer of the same resin as the innermost layer of said container body, the spout-attached film being heatsealed to an area between the outermost layer of said connecting film and a portion of the outermost layer of said sealing film adjoining the first hole in said container body so that a part of said spout-attached film surrounding the third hole in said spout-attached film adjoins said portion of the outermost layer of said sealing film; the spout of a polyolefin resin being heatsealed to the outermost layer of said spout-attached film; and said container body and said spout sandwiching said connecting and said spout-attached film sequentially arranged from said container body.

* * * * *

UNITED STATES PATENT AND TRADEMARK OFFICE

CERTIFICATE OF CORRECTION

PATENT NO. : 5,325,983

DATED : July 5, 1994

INVENTOR(S) : Takayuki IMAI, et al.

It is certified that error appears in the above-indentified patent and that said Letters Patent is hereby corrected as shown below:

Column Col. 2, lines 26 and 31, delete "1" and insert therefor --j--;
Line 63, delete "Joint" and insert therefor --joint--.
Column 5, line 18, delete "Gas" and insert therefor --gas--;
Line 38, delete "Good" and insert therefor --good--.
Column 6, line 52, delete "pl".
Column 7, before line 25, insert a blank line and the following title, centered: --EXAMPLE 4--.
Column 8, after "Control 2", "Control 3" and "Control 4", in the column "Nature Observation", delete "There were some liquid containers in which some solution infiltrated part surrounding the spout." and insert therefor --"--.

Signed and Sealed this

Eighth Day of October, 1996

Bruce Lehman

*Attest:*

BRUCE LEHMAN

*Attesting Officer*

*Commissioner of Patents and Trademarks*